US005799465A

United States Patent [19]

Townsend

[11] Patent Number: 5,799,465

[45] Date of Patent: Sep. 1, 1998

[54] BAG FILLING STATION

[75] Inventor: Gerald Leo Townsend, Wausaukee, Wis.

[73] Assignee: Optima Corporation, Green Bay, Wis.

[21] Appl. No.: 679,531

[22] Filed: Jul. 12, 1996

[51] Int. Cl.[6] ..... B65B 5/00

[52] U.S. Cl. ..... 53/258; 53/257; 53/572

[58] Field of Search ..... 53/571, 572, 573, 53/255, 257, 258, 384.1, 385.1, 386.1; 493/478, 479

[56] References Cited

U.S. PATENT DOCUMENTS

| | | | |
|---|---|---|---|
| 3,501,893 | 3/1970 | Peterson | 53/190 |
| 3,869,065 | 3/1975 | Wang | 221/40 |
| 3,916,603 | 11/1975 | Kristiansen | 53/384 |
| 4,020,618 | 5/1977 | Benzon-Petersen et al. | 53/390 |
| 4,172,349 | 10/1979 | Lipes | 53/459 |
| 4,291,517 | 9/1981 | Lipes | 53/468 |
| 4,700,755 | 10/1987 | Banys | 141/114 |
| 5,142,840 | 9/1992 | Cappi et al. | 53/384.1 |

*Primary Examiner*—Linda Johnson
*Assistant Examiner*—John Paradiso
*Attorney, Agent, or Firm*—Godfrey & Kahn, S.C.

[57] ABSTRACT

A bag filling station including a main body having a loading bay with a bottom, a first end, and a second end. The bottom of the loading bay may be movable in a horizontal direction. At the first end of the loading bay is a loading ram or actuator having a pusher arm which is also movable in a horizontal direction. Adjacent to the loading bay, at its second end, are two spreader plates, each of which is coupled to the main body and movable between a rearward position and a forward position. Each spreader plate is also moveable along a linear path, between a first, open position and a second, closed position. The bag filling station also includes a platform which is located near and above the second end of the loading bay and has a centrally positioned opening. A stack of bags is placed on the platform over the opening. Under the platform, near the second end of the loading bay, is a vertically oriented, linear actuator or rod. The rod has a top end with a finger mounted thereto and is capable of moving between a first, lower position and a second, upper position and between a first, rearward position and a second, forward position. In operation, the bottom side of a single bag on the platform is pulled through the opening in the platform by means of the finger on the vertically oriented rod.

21 Claims, 8 Drawing Sheets

BAG FILLING STATION

BACKGROUND OF THE INVENTION

The present invention relates to devices for opening and filling plastic and other bags. More particularly, the present invention relates to a bag filling station where empty bags are fed to the device in a downward direction.

Bag opening and filling devices have been developed for a variety of applications. Generally, known devices have one or more mechanisms for selecting a single bag from a stack of flattened, usually folded bags and holding the selected bag open for filling. For example, U.S. Pat. No. 4,700,755, issued to Banys, discloses a bag opener and filling system which includes a wicket mounted on a frame. The wicket holds a stack of bags in a vertical orientation. A piston assembly is mounted on the frame and includes a rod capable of moving in a horizontal plane. The rod moves in a first direction so that a pin penetrates one side of the first bag in the stack. The rod then reverses direction causing the bag to open. The bag is held open, cut from the wicket, and product is then fed from above into the bag. While the device developed by Banys and others like it are suitable for some applications, they are unsatisfactory for others.

In modern package and filling applications many different types of products are loaded into plastic bags, and it is not possible to simply pour or otherwise allow product to flow into a bag from above. In order to package diapers, sanitary napkins, paper napkins and other similar products it is necessary that the product be gathered, compacted, or otherwise arranged before it is placed in a bag. Very large, highly automated machines have been developed for this purpose and are, in general, satisfactory. However, the cost of these machines is prohibitive for many smaller manufacturers. Further, they are suitable only for mass-production facilities where large amounts of product are packaged. Further still, such machines are not completely effective at packaging product due to occasional jamming of the packaging line and similar problems. Thus, a certain amount of product will not be packaged or will be mispackaged by these machines. However, it is very difficult, if not impossible, to reload any loose product back into the packaging line so that it may be packaged properly.

Thus, there is a need for a smaller, less costly device which may be used to package various products in plastic bags and the like and produce a final package which is of comparable or the same quality as larger machines. In addition, it would be beneficial if such a machine could be operated by a single person. There is a further need for a device which may be used in conjunction with larger devices in order to repackage any loose product which fails to be properly packaged during the original packaging process. Further still, there is a need for a device where a relatively large number of bags may be loaded or otherwise provided to the packaging device so that product may be packaged at a relatively high rate without the need of replenishing the supply of bags at a similarly high rate.

OBJECTS AND SUMMARY OF THE INVENTION

Therefore, it is an object of the present invention to provide a bag filling station or packaging device of relatively small size and that may be operated by a single person.

A further object of the present invention is to provide a bag filling station that may be used to package various products in plastic bags and the like and which packages those products at a quality level that is similar to or the same as larger machines.

A further object of the present invention is to provide a bag filling device where a relatively large amount of empty bags may be supplied to the device allowing product to be packaged at a relatively high rate without requiring the replenishment of the supply of bags at a similarly high rate.

These and other objects are achieved in a bag filling station that includes a main body such as a frame. Within the main body is a loading bay having a top opening, a bottom, two loading plates adjustably mounted on the bottom, a first end, and a second end. In one embodiment of the present invention, the bottom of the loading bay is movable in a horizontal direction between a first, rearward position and a second, forward position. Various sensors may be positioned near or in the loading plates to detect the presence of articles (referred to as product) in the loading bay. At the first end of the loading bay is a loading ram or actuator. The loading actuator has a pusher arm which moves from a first retracted position to a second extended position. It pushes product out from between the loading plates through the second end of the loading bay.

Adjacent to the loading bay, at its second end, are two spreader plates. Each of the spreader plates is coupled to the main body of the bag filling station and each is movable in a horizontal direction, between a rearward position and a forward position. In addition, each spreader plate is movable along a linear path, between a first open position and a second closed position. Each of these paths is a mirror image of the other. When each spreader plate is at its respective first position, the plates are spaced apart from one another. When each spreader plate is at its respective second position, the plates are in close proximity to one another.

The bag filling station also includes a platform located near and above the second end of the loading bay. The platform is capable of supporting a plurality of bags and has a centrally positioned opening over which a stack of bags may be placed. Under the platform, near the second end of the loading bay, is a substantially vertically oriented, pneumatically powered rod. The rod has a top end with a finger mounted thereto and is capable of moving between a first lower position and a second upper position. In addition, the rod is capable of moving between a first, rearward position and a second, forward position.

The bag filling station may also include a nozzle coupled to the main body adjacent to the platform. The nozzle is capable of being coupled to a source of gas, such as pressurized air. In operation, the top side of a single bag on the platform is pulled through the opening in the platform by means of the finger on the substantially vertically oriented rod. A pulse or shot of pressurized air may be used to assist separation of the top and bottom sides of the bag from each other. After the top side of the bag is pulled down, the spreader plates further open the bag, holding its top, bottom, left, and right sides apart. Once the bag is opened, the pusher arm moves product from the loading bay into the bag. The force caused by pushing the product into the bag removes it completely from the platform to a chute or conveyor belt which transports the now filled bag to other packaging stations such as a bag sealer.

Further objects and advantages of the present invention will become more apparent from the following detailed description of the invention taken in combination with the accompanying drawings.

DETAILED DESCRIPTION OF THE INVENTION

Figure 1:
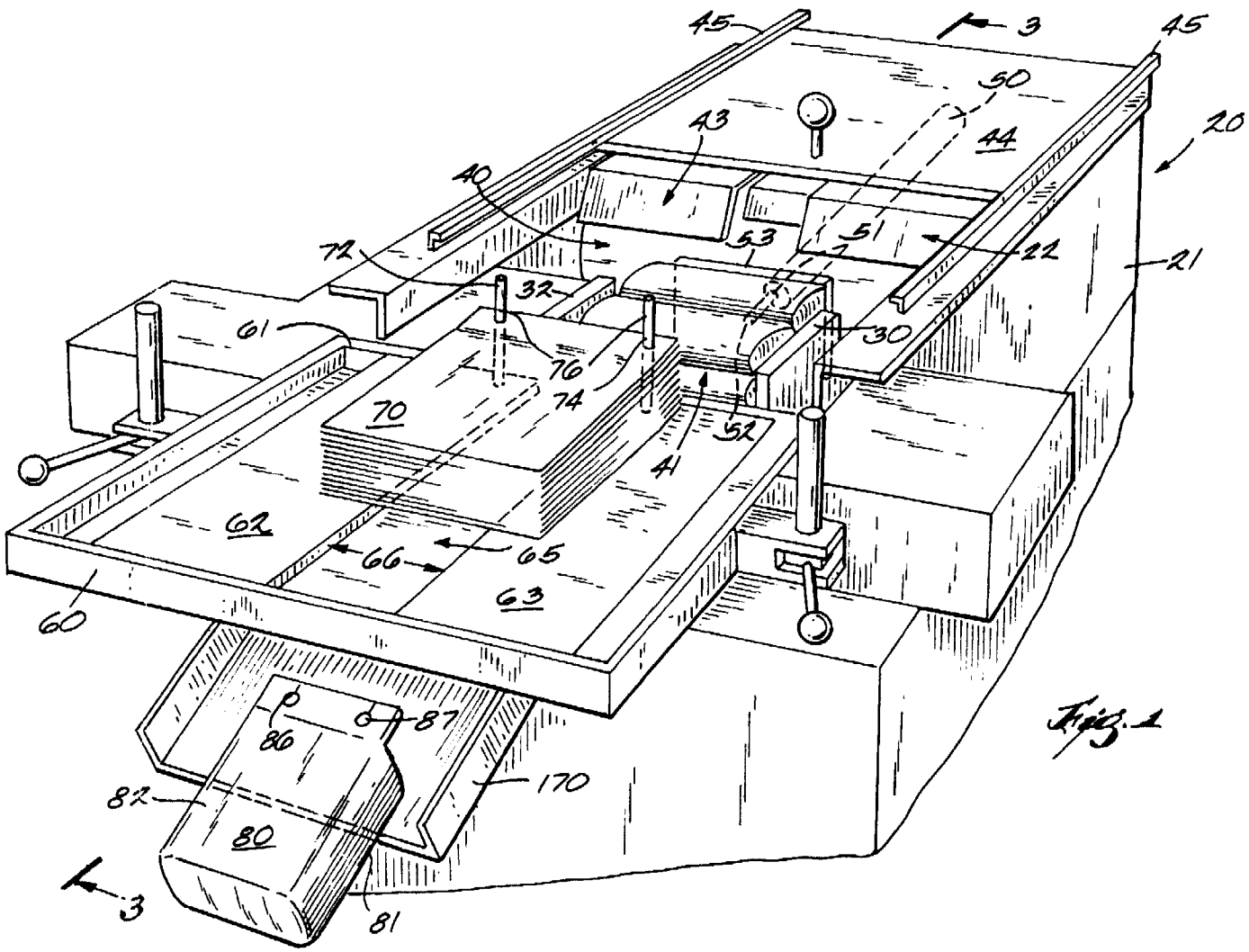
FIG. 1 is a left end perspective view of a bag filling station constructed in accordance with the present invention.
Figure 3:
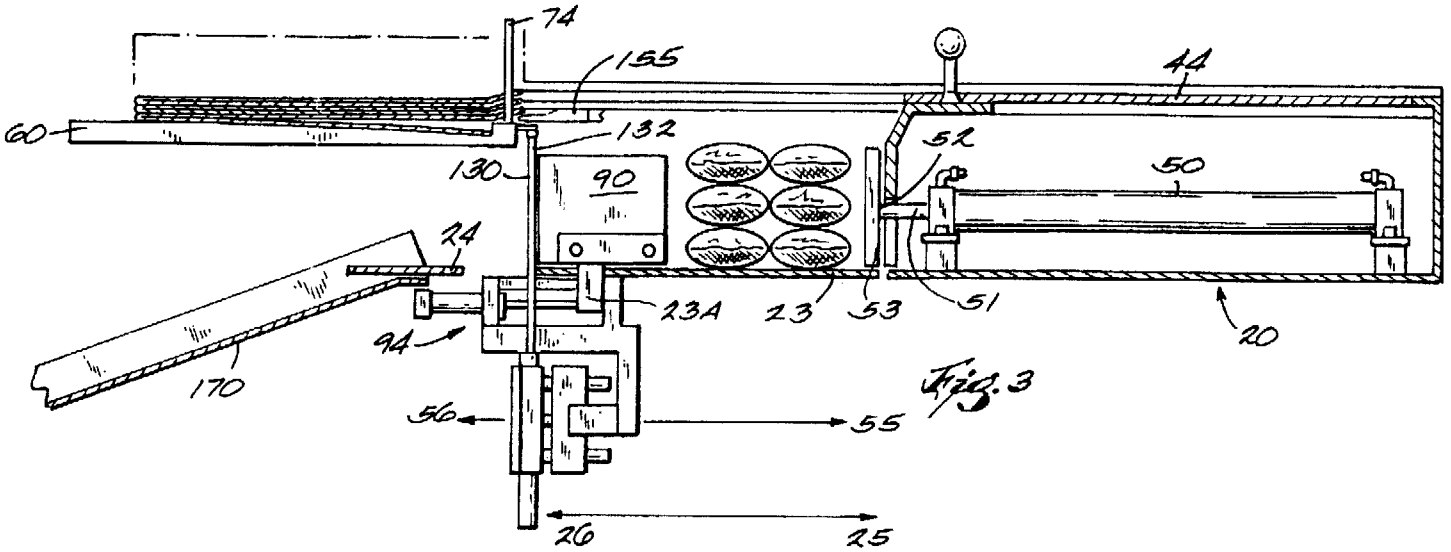
FIG. 3 is a longitudinal cross-sectional view of the bag filling station of FIG. 1 taken along the line 3—3 of FIG. 1 and shows the pusher arm in a first retracted position.
Figure 4:
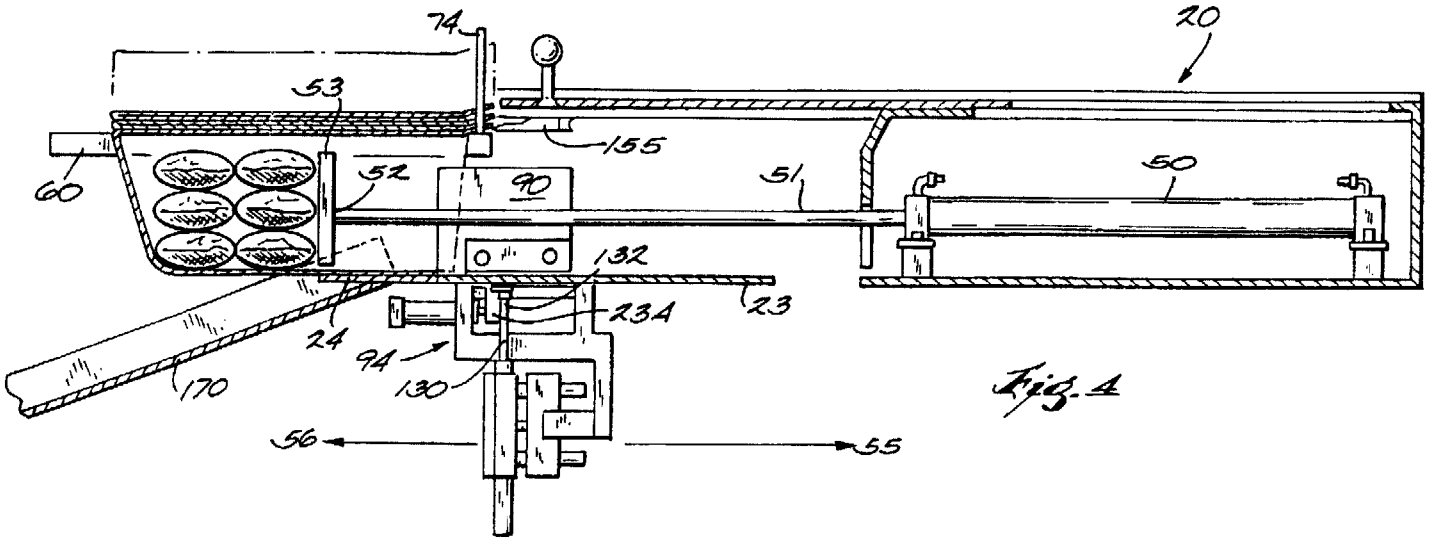
FIG. 4 is a longitudinal cross-sectional view of the bag filling station of FIG. 1 taken along the line 3—3 of FIG. 1 and shows the pusher arm in a second extended position.

A bag filling station 20 is shown in FIG. 1. The bag filling station 20 includes a main body 21, which in the preferred form is a rectangularly shaped frame or box. The main body 21 includes a loading bay 22 having a bottom 23 (FIGS. 3 and 4). The bottom 23 may be coupled to the main body in a fixed, stationary position. However, the bottom 23 may also be coupled to a first spreader plate slide 23A and a second spreader plate slide (not shown) so as to be movable in a horizontal direction between a first rearward position 25 and a second forward position 26. In yet another embodiment (not shown), the bottom 23 is movable in a vertical direction to permit automatic loading of product into the loading bay 22. Positioned adjacent to the bottom 23 is a second plate 24 which is fixedly coupled to the main body 21.

Referring again to FIG. 1, adjustably mounted on the bottom 23 is a first loading plate 30, and a second loading plate 32, spaced apart from and mounted in facing relationship to the first loading plate 30. The spacing between loading plates 30 and 32 may be adjusted along the bottom 23 to accommodate the width of the product to be packaged. Proximity or other sensors (not shown) may be mounted in or near the plates to detect the presence or absence of product in the loading bay 22.

The loading bay 22 also has a first end 40, a second end 41, and a top opening 43 which may be sealed by a door 44. The door 44 is held in tracks 45 and sensors (not shown) may be positioned in or near the tracks in order to sense whether the door 44 is in an open or closed position.

A loading ram or actuator 50 is located adjacent to the loading bay 22 near the first end 40. The loading actuator 50 has a pusher arm 51 which has a first end 52 on which a plate 53 is mounted. As best seen in FIGS. 3 and 4, the first end 52 is movable between a first, retracted position 55 and a second, extended position 56.

Coupled to the main body 21 near the second end 41 of the loading bay 22 is a platform 60. The platform 60 includes an inner peripheral edge 61, a first plate 62, and a second plate 63. The first plate 62 and second plate 63 are separated by a gap or opening 65. The opening 65 is centrally positioned in the platform, rectangularly shaped, and has a width 66. A plurality or stack 70 of folded, flattened bags, preferably plastic bags, sits over a portion of the opening 65 and is supported by the plates 62 and 63. For optimal performance, the width 66 of the opening 65 is preferably about one-third the width of the bags in the stack 70. The plates 62 and 63 may be adjustably mounted in the platform so that the width of the opening 65 may be changed. The stack 70 is held in place by two vertical rods 72 and 74. Both are coupled to the platform 60 and positioned near the inner peripheral edge 61. The rods form a wicket 76.

Figure 5:
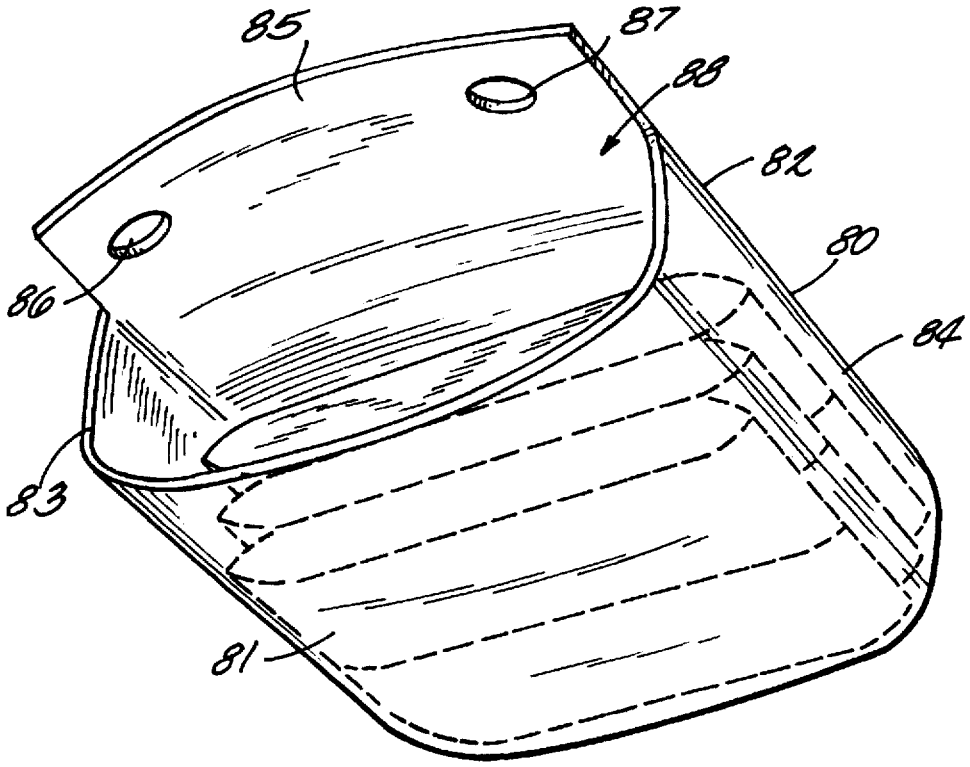
FIG. 5 is a perspective view of a bag shown filled with product.

As best seen by reference to FIG. 5, each individual bag 80, a group of which make up the stack, has a top 81, a bottom 82, a first or left side 83 and a second or right side 84. The bottom side 82 has an extension 85 with two apertures 86 and 87. The top 81, bottom 82, left side 83, and right side 84 define a mouth 88. For purposes of illustration, the thickness of the top 81, bottom 82, left side 83, and right side 84 is greatly exaggerated. Typically, a stack of five hundred plastic bags is about 2 to 3 inches thick. Thus, the thickness dimension of a single bag is on the order of 0.01 to 0.001 inches.

As shown in FIGS. 3 and 4, the bags are placed on the wicket 76 in a flattened form, with each of their tops 81 facing down, and with the rods 72 and 74 extending through the apertures 86 and 87, respectively.

Figure 2:
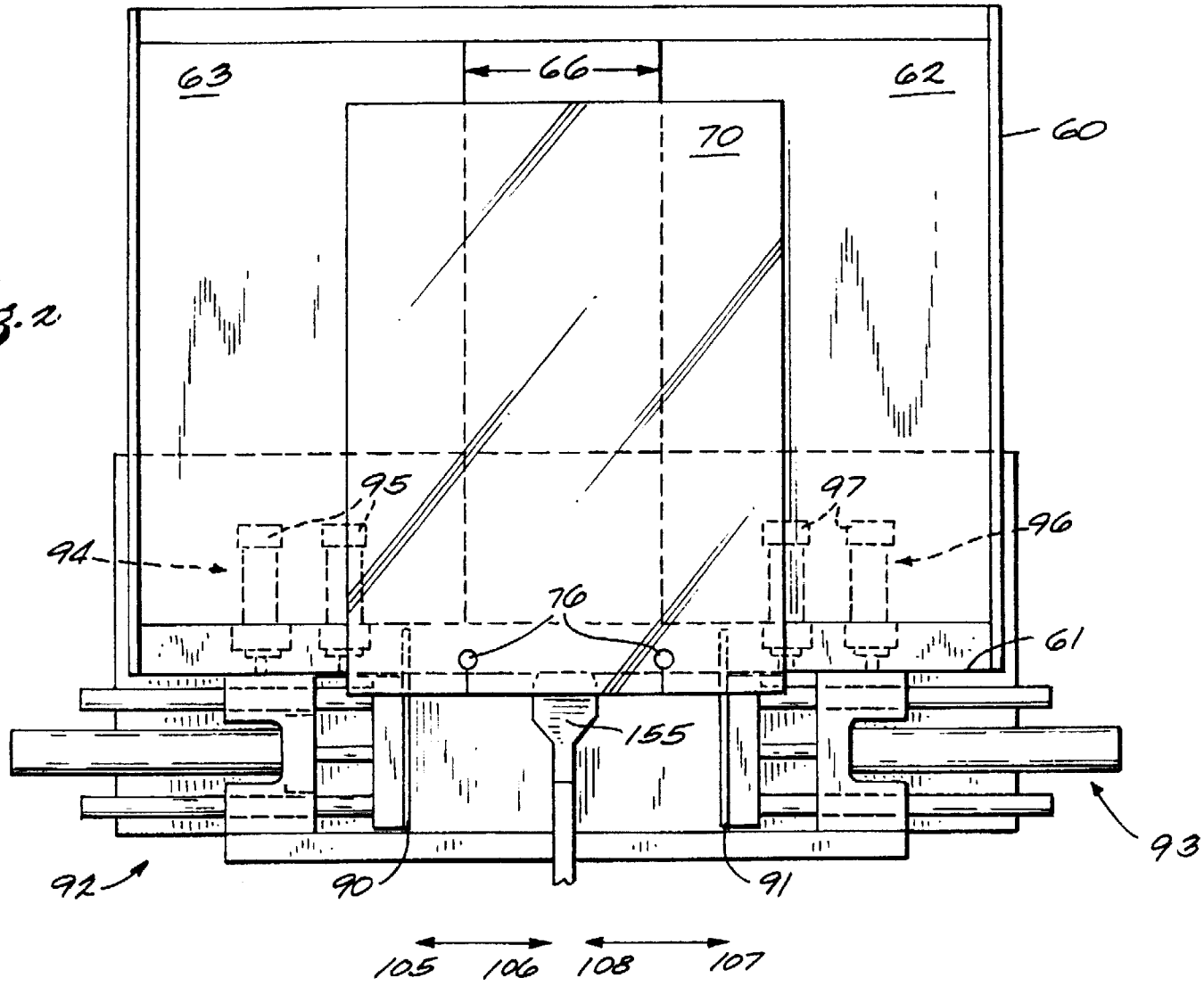
FIG. 2 is a top plan view of the platform of the bag filling station of FIG. 1.

Adjacent to the second end 41 of the loading bay 22 are two spreader plates 90 and 91 (FIG. 2). The plate 90 is coupled to a linear actuator 92 such as a pneumatically powered piston assembly, which controls motion of the plate in a first linear path, discussed further below. The plate 90 is also coupled to a second piston assembly 94, which in this embodiment includes a pair of pneumatically powered rods 95 to move it along a second linear path. Similarly, the plate 91 is coupled to a linear actuator assembly 93, which controls motion of the plate in a first linear path. The plate 91 may be coupled to a second linear actuator assembly 96, which in this embodiment includes a pair of pneumatically powered rods 97 to move plate 91 along a second linear path.

As noted, each spreader plate is capable of moving in two directions along a horizontal plane. The first direction of movement is along a linear path between a first, closed position and a second, open position. Specifically, the spreader plate 90 is movable along a linear path of travel between an open position 105 and a closed position 106 (FIG. 2). The spreader plate 91 is movable along a linear path of travel between an open position 107 and a closed position 108. When each spreader plate is at its respective open position the plates are spaced apart from one another. When each spreader plate is at its respective closed position the plates are in close proximity to each other.

The second direction of motion of the spreader plates 90 and 91 is transverse to the first direction. This motion is controlled by the two second piston assemblies 94 and 96. However, it is possible to control the second direction of both spreader plates with a single piston assembly. As best seen by reference to FIGS. 11 and 12, each of the spreader plates is movable in a forward and back direction. The spreader plate 90 is movable along a linear path of travel between a first, rearward position 110 and a second, forward position 111. Likewise, the spreader plate 91 is movable along a linear path of travel between a first, rearward position (not shown) and a second, forward position (not shown).

As was mentioned above, in one embodiment the bottom 23 is movable in a horizontal direction between the first rearward position 25 and the second forward position 26. The bottom 23 is coupled to the first and second spreader plate slides and the first spreader plate slide 23A and second spreader plate slide are components of the piston assemblies 94 and 96, respectively. Thus, the bottom 23 moves in correlation to the spreader plates 90 and 91.

Figure 6:
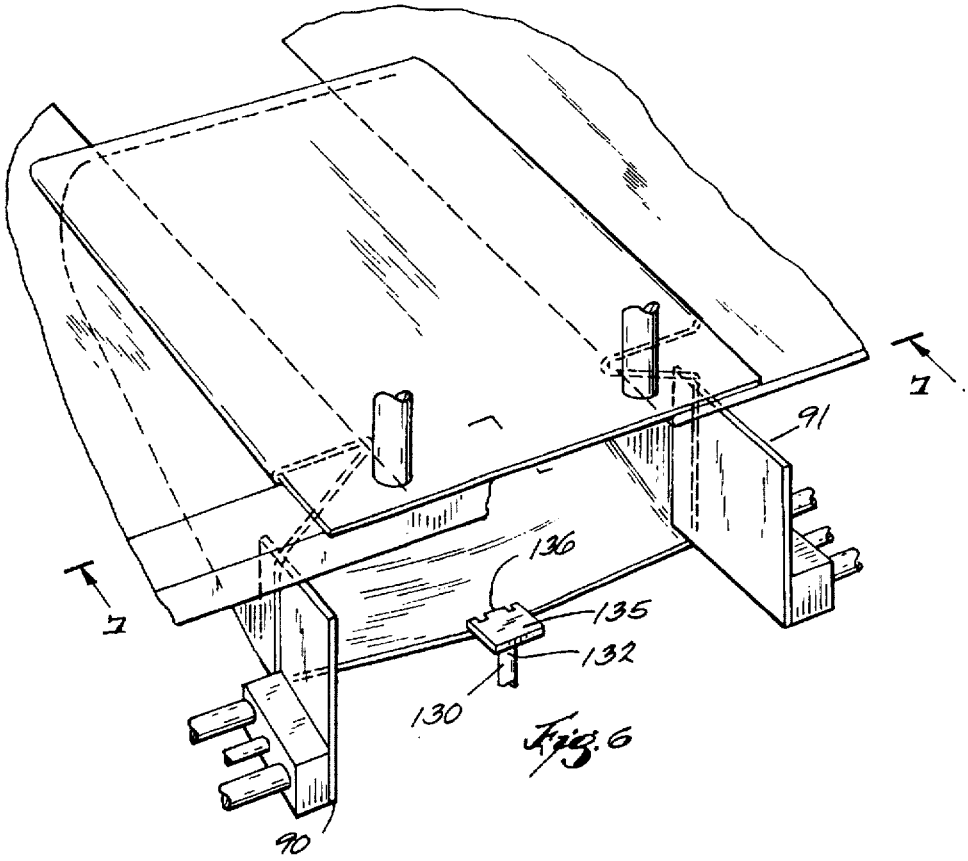
FIG. 6 is a perspective view of a bag showing the mouth of the bag being held open by the spreader plates of the bag filling station of FIG. 1.
Figure 7:
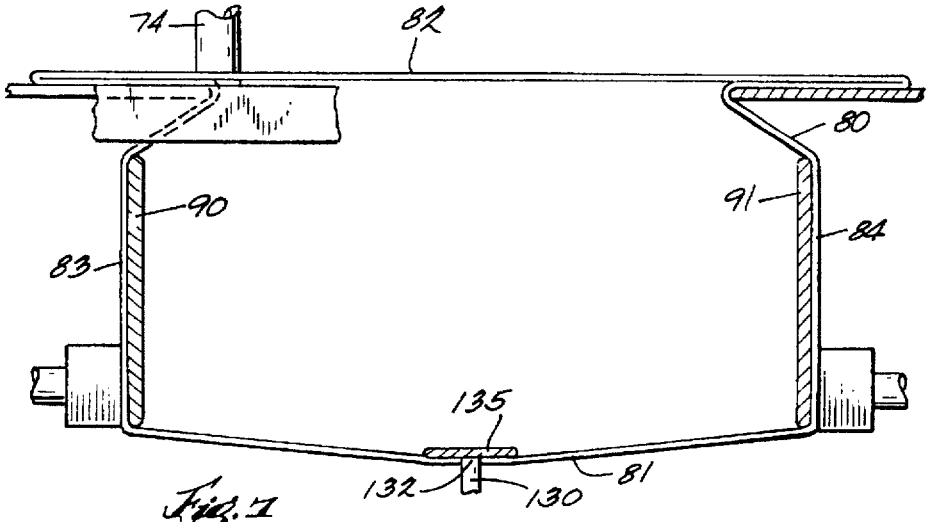
FIG. 7 is a cross-sectional view of the mouth of the bag shown in FIG. 6 taken along the line 7—7 of FIG. 6.
Figure 8:
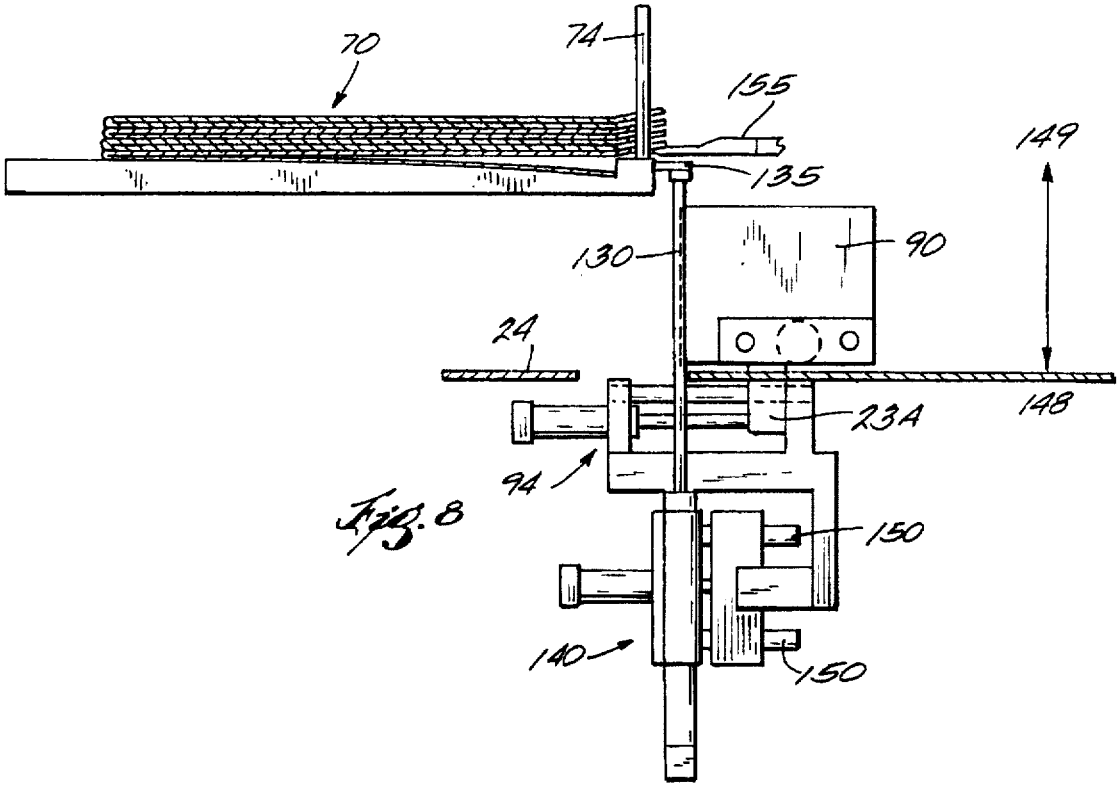
FIG. 8 is side view showing the operation of the vertical rod and grabbing finger of the bag filling station of FIG. 1, and shows the vertical rod in an upper, rearward position.

A vertical, linear actuator 130, such as a pneumatically powered rod, is positioned adjacent to the second end 40 of the loading bay 22 and is coupled to the main body 21. The actuator 130 is centrally positioned (FIGS. 6 and 7) along an axis which defines a mid-line of the loading bay 22. The actuator has a top end 132 having a toothed plate or finger 135 mounted thereon. The toothed plate or finger 135 has a leading edge 136 in which one or more teeth may be cut or otherwise formed. Preferably, the finger 135 has two notches (FIG. 6) cut in its leading edge 136 (FIG. 6).

Figure 9:
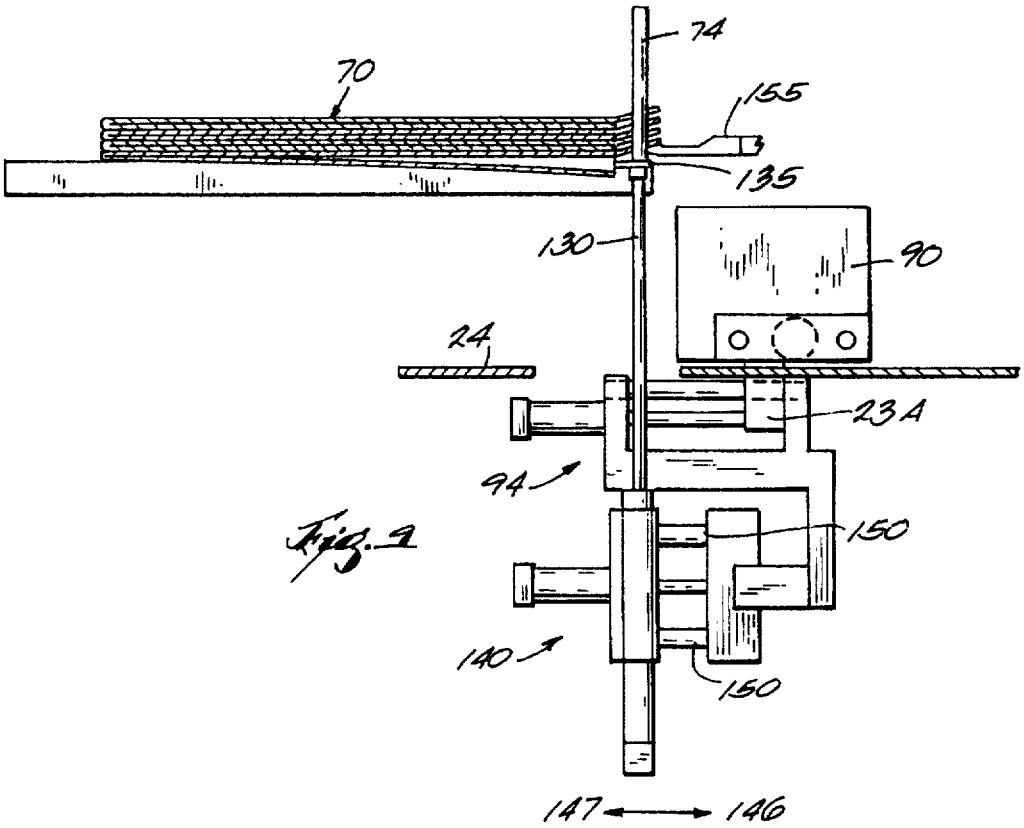
FIG. 9 is another side view showing the vertical rod and grabbing finger of the bag filling station of FIG. 1 in an upper, forward position.
Figure 10:
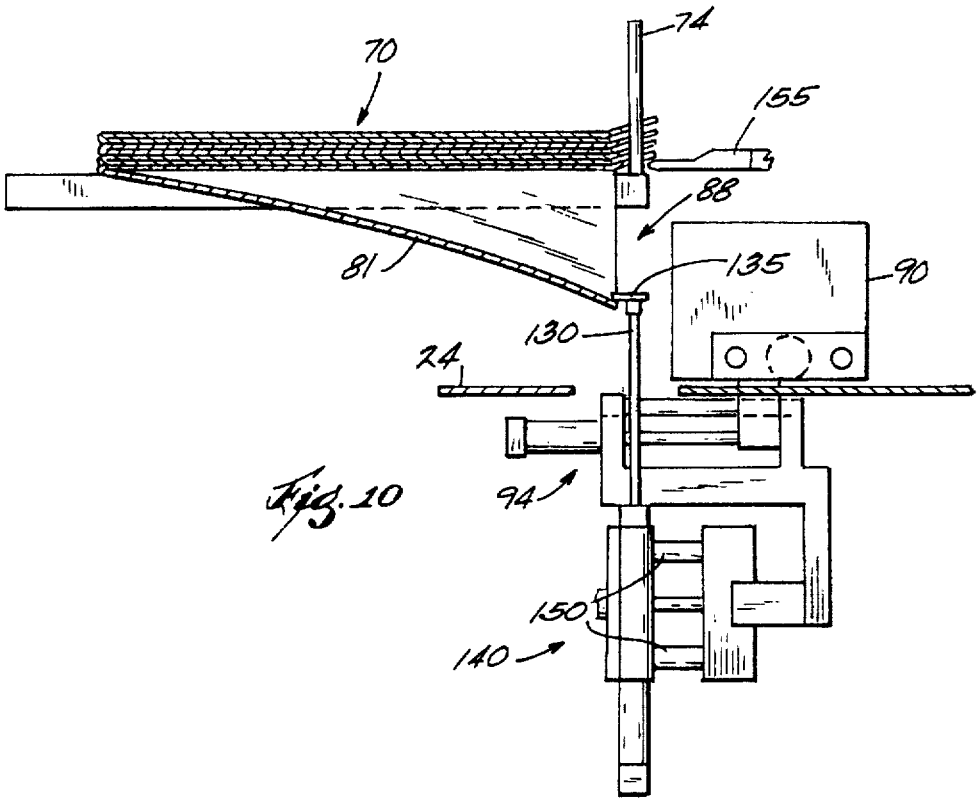
FIG. 10 is another side view showing the vertical rod and grabbing finger of the bag filling station of FIG. 1 in an intermediate, forward position.
Figure 11:
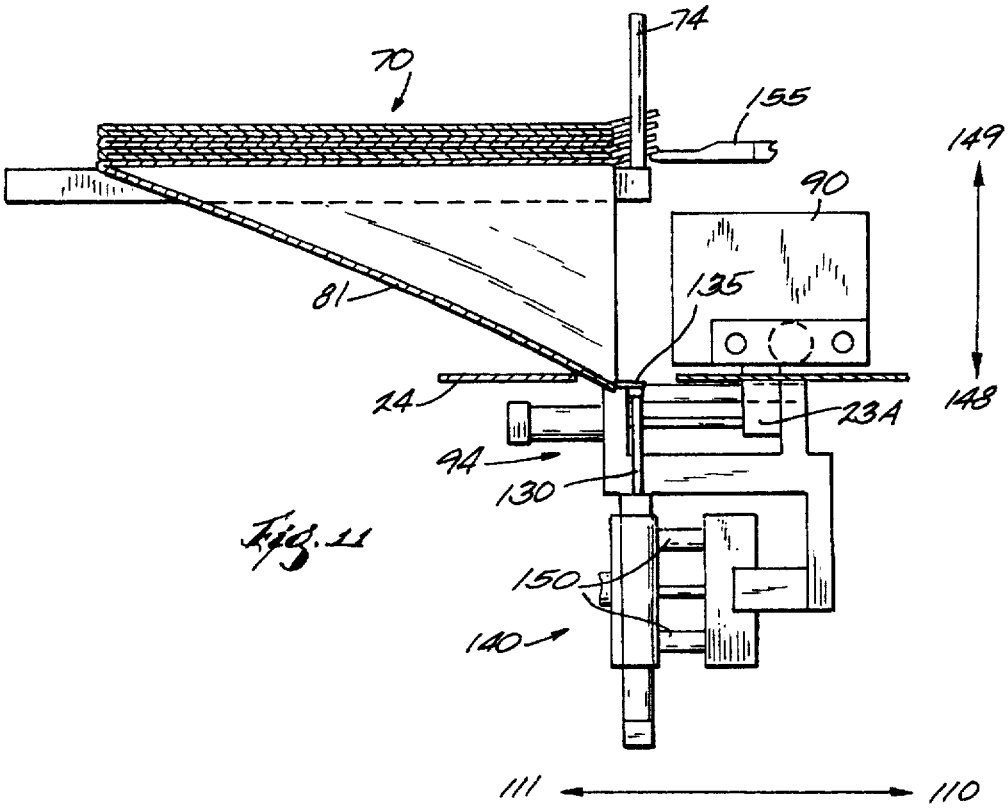
FIG. 11 is another side view showing the vertical rod and grabbing finger of the bag filling station of FIG. 1 in a bottom, forward position.
Figure 12:
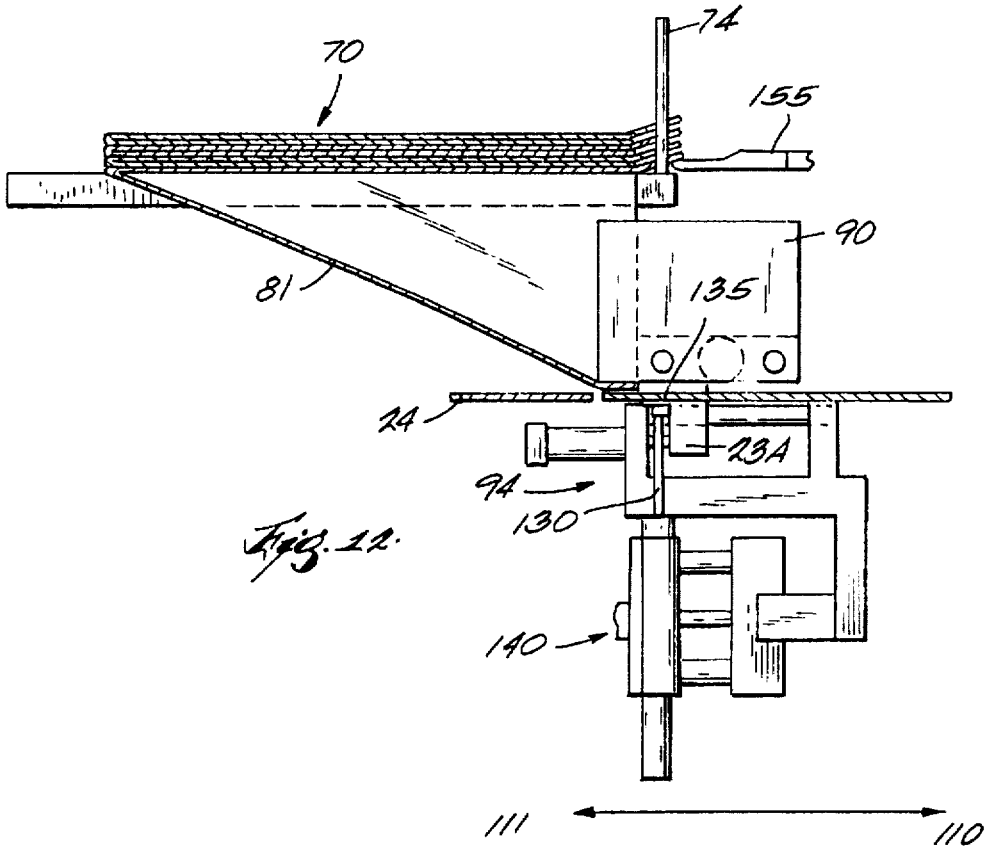
FIG. 12 is another side view showing the vertical rod and grabbing finger of the bag filling station of FIG. 1 in a bottom, forward position and the spreader plates holding the mouth of a bag open.
Figure 13:
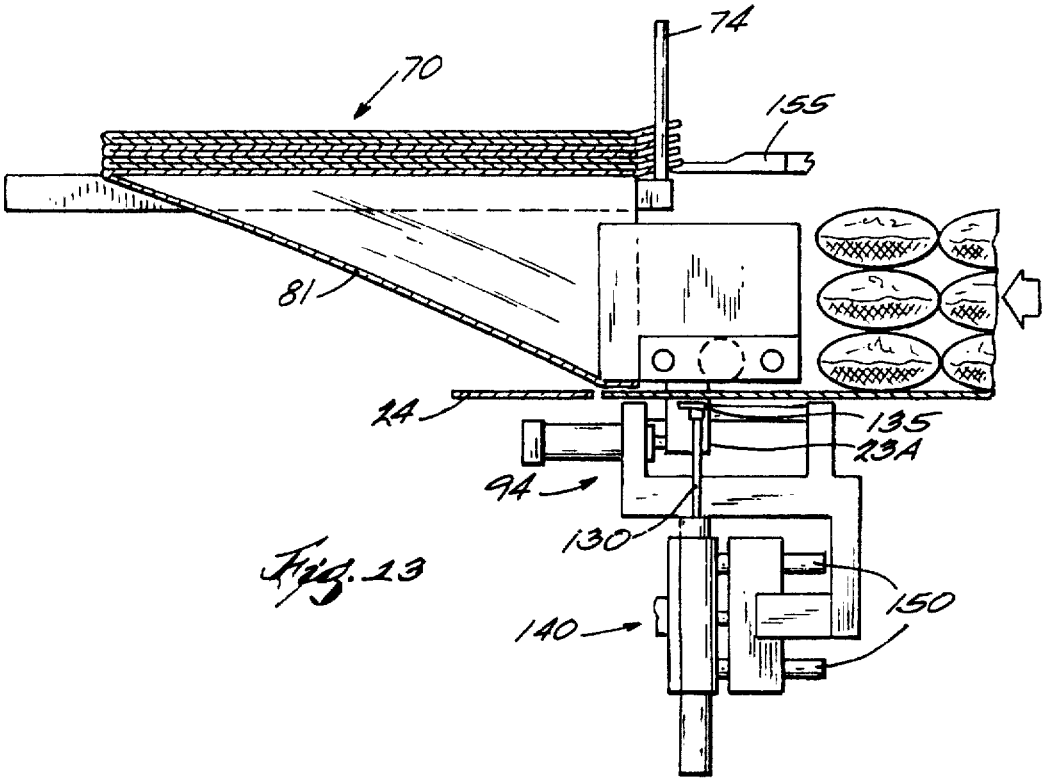
FIG. 13 is another side view showing the vertical rod and grabbing finger of the bag filling station of FIG. 1 in a bottom, rearward position and product ready to be pushed into the mouth of the bag.

As best seen by reference to FIGS. 8 through 11, the linear actuator 130 is capable of moving the finger 135 vertically, between a first, lower position 148 and a second, upper position 149 (compare FIGS. 9, 10, and 11). The finger 135 is also movable in a horizontal direction, between a first, rearward position 146 and a second, forward position 147 (compare FIGS. 8 and 9). This horizontal movement is accomplished in the preferred embodiment by means of a linear actuator 140, such as a pneumatic cylinder, moving the entire linear actuator 130 in this horizontal direction, between a forward and a rearward position, along sliders 150 which are coupled to the main body 21.

Coupled near the second end 41 of the loading bay 22, near the top opening 43 is a nozzle 155. The nozzle 155 is coupled via an air line (not shown) to a source of gas, preferably pressurized air (also not shown). The nozzle 155 is positioned so that the gas flowing out of it is directed at the lower most bag of the stack of bags 70. The gas coming from the nozzle tends to separate the top 81 from the bottom 82 of each single bag 80.

OPERATION

In operation, the platform 60 of the bag filling station 20 is loaded with a stack 70 of bags 80. The bags are loaded so that the top side 81 of each of the bags faces downward. The loading bay 22 is loaded with product and the door 44 is closed. The closing of the door 44 is sensed by the sensors in the tracks 45 and the filling cycle begins.

As can been seen by reference to FIGS. 8–13, the vertical rod moves from its bottom, rearward position (FIG. 13) to its upper, forward position and the finger 135 is pushed between the top 81 and bottom 82 of an individual bag 80 (FIG. 9). To ensure that the top and bottom sides 81 and 82 of the bottommost bag are separated, a pulse of air or other gas is sent out of the nozzle 155. The top side 81 is pulled through the opening 65 of the platform 60 by means of the finger 135 on the rod 130 as it moves from the upper, forward position to its bottom, forward position. In this motion, the top side 81 is pulled through the opening 65 down to a position where the finger 135 is in a plane which is parallel, and roughly coplanar, to the bottom 23 of the loading bay 22. Though the finger has been shown as a toothed finger, it is possible that a vacuum finger could be mounted on the actuator 130 and used to pull the top side 81 of each bag through the opening 65.

Once the top side of the bag is pulled down, the spreader plates 90 and 91 move from their open positions 105, 107 to their closed positions 106, 108. The spreader plates 90 and 91 then move from their rearward positions to their forward positions and bottom 23 moves together with them from its rearward position 25 to its forward position 26. The spreader plates 90 and 91 then move to the their open positions 105, 107, and in the process of doing so each respective spreader plate engages the left and right sides 83 and 84 of the bag 80, fully opening the mouth 88 and separating the top, bottom, left, and right sides of the bag. Once the bag 80 is opened the pusher arm 51 moves from the first retracted position 55 to the second extended position 56, pushing product from the loading bay 22 into the bag 80 (FIG. 4). As product is pushed completely into the bag, the apertures on the extension 85 tear, releasing the filled bag from the wicket 76. The released bag is then caught by a chute 170 (FIG. 1), or similar device, and may, for example, be carried to a bag sealing mechanism (not shown). As the bag is being torn from the wicket 76, the pusher arm 51 moves back to the retracted position 55, the spreader plates 90 and 91 move back to their rearward positions 110, 111, and the bottom 23 moves back to its rearward position 25. The cycle is repeated for filling the next bag.

As should be appreciated, the present invention uses a number of linear actuators, pneumatically powered cylinders, rods, rams, and other complementary components such as slides. Such devices and components are known to those skilled in the art. In addition, the movement of these parts is preferably controlled by one of many commercially available programmable logic controllers or PLCs, the use of which is known and well understood. The PLC controls solenoid actuated valves that control the air flow to and from the pneumatically controlled cylinders of the invention.

While the present invention has been described in what is believed to be the most preferred forms, it is to be understood that the invention is not confined to the particular construction and arrangement of the components herein illustrated and described, but embraces such modified forms thereof as come within the scope of the appended claims. In particular, it should be understood that the bottom 23 may be fixed, may move in a horizontal direction, or may move in a vertical direction.

What is claimed is:

1. A bag filling device comprising:

a main body;

a loading bay positioned within the main body and having a bottom, two sides, a rear, and a front;

a loading actuator coupled to the main body, positioned adjacent to the rear of the loading bay, and having a pusher arm movable between a first, retracted position at the rear of the loading bay and a second, extended position near the front of the loading bay;

a platform for supporting a plurality of bags, positioned forward of and above the loading bay and having an opening therein;

a pair of spreader plates coupled to the main body, positioned at the front of the loading bay, each spreader plate movable between a first, open position near the side of the loading bay and a second, closed position near the center of the front of the loading bay and between a first, rearward position adjacent to the platform and a second, forward position partially under the platform;

a finger coupled to the main body movable between a first, lower position level with the loading bay and a second, upper position level with the platform and between a first, rearward position adjacent to the platform and a second, forward position under the platform;

and means for moving said finger to pull one side of a single bag of the plurality of bags on the platform through the opening in the platform from said upper position to said lower position.

2. A bag filling device as claimed in claim 1, further comprising a nozzle mounted on the main body adjacent the opening in the platform and capable of being coupled to a source of gas.

3. A bag filling device as claimed in claim 1, wherein the finger has at least one tooth.

4. A bag filling device as claimed in claim 1, further comprising:

first and second loading plates adjustably mounted on the bottom of the loading bay.

5. A bag filling device as claimed in claim 1, further comprising:

first and second plates adjustably mounted on the platform.

6. A bag filling device as claimed in claim 1, further comprising a wicket coupled to the platform.

7. A bag filling device as claimed in claim 1, wherein the finger is mounted on a top end of a substantially vertically oriented rod.

8. A bag filling device comprising:

a main body;

a loading bay positioned within the main body and having a bottom and a top opening, two sides, a rear, and a front;

first and second loading plates adjustably mounted on the bottom of the loading bay;

a loading actuator coupled to the main body, positioned adjacent to the rear of the loading bay, and having a pusher arm movable between a first, retracted position at the rear of the loading bay and a second, extended position near the front of the loading bay;

a platform for supporting a plurality of bags, positioned forward of and above the loading bay, and having an opening therein;

a pair of spreader plates coupled to the main body, positioned at the front of the loading bay, each spreader plate movable between a first, open position near the side of the loading bay and a second, closed position near the center of the front of the loading bay and between a first, rearward position adjacent to the platform and a second forward position partially under the platform;

first and second plates adjustably mounted on the platform;

a finger coupled to the main body and movable between a first, lower position level with the loading bay and a second, upper position level with the platform and between a first, rearward position adjacent to the platform and a second, forward position under the platform;

and means for moving said finger to pull one side of a single bag of the plurality of bags on the platform through the opening in the platform from said upper position to said lower position.

9. A bag filling device as claimed in claim 8, further comprising a nozzle mounted on the main body adjacent the opening in the platform and capable of being coupled to a source of gas.

10. A bag filling device as claimed in claim 8, wherein the finger has at least one tooth.

11. A bag filling device as claimed in claim 8, further comprising a wicket coupled to the platform.

12. A bag filling device as claimed in claim 8, wherein the finger is mounted on a top end of a substantially vertically oriented rod.

13. A bag filling device comprising:

a main body;

a loading bay positioned within the main body and having a bottom, rear, and a front;

a loading ram coupled to the main body, positioned adjacent to the rear of the loading bay, and having a pusher arm movable between a first, retracted position at the rear of the loading bay and a second, extended position near the front of the loading bay;

a platform for supporting a plurality of bags, positioned forward of and above the loading, bay, and having an opening therein;

a pair of spreader plates coupled to the main body, positioned adjacent the loading bay, and spaced from the loading ram, each spreader plate movable in a first direction of motion and a second direction of motion which is transverse to the first direction;

at least one first piston assembly coupled to the main body for controlling the motion of the spreader plates in the first direction of motion;

at least one second piston assembly coupled to the main body for controlling motion of the spreader plates in the second direction of motion;

a substantially vertically oriented rod coupled to the main body and having a top end with a finger mounted thereto and movable between a first, lower position level with the loading bay and a second, upper position level with the platform and between a first, rearward position adjacent to the platform and a second, forward position under the platform;

and means for moving said finger to pull one side of a single bag of the plurality of bags on the platform through the opening in the platform from said upper position to said lower position.

14. A bag filling device as claimed in claim 13, further comprising a nozzle mounted on the main body adjacent the opening in the platform and capable of being coupled to a source of gas.

15. A bag filling device as claimed in claim 13, wherein the finger has at least one tooth.

16. A bag filing device as claimed in claim 13, further comprising a wicket coupled to the platform.

17. A bag filling device comprising:

a main body;

a loading bay positioned within the main body and having a bottom, two sides, a rear, and a front, said bottom movable between a first, rearward position at the rear of the loading bay and a second, forward position near the front of the loading bay;

a loading ram coupled to the main body, positioned adjacent to the rear of the loading bay, and having a pusher arm movable between a first, retracted position at the rear of the loading bay and a second, extended position near the front of the loading bay;

a platform for supporting a plurality of bags, positioned forward of and above the loading bay, and having an opening therein;

a pair of spreader plates coupled to the main body, positioned at the front of the loading bay, each spreader plate movable between a first, open position near the side of the loading bay and a second, closed position near the center of the front of the loading bay and between a first, rearward position adjacent to the platform and a second, forward position partially under the platform;

a substantially vertically oriented rod coupled to the main body and having a top end with a finger mounted thereto and movable from a first, lower position level with the loading bay to a second, upper position level with the platform and from a first, rearward position adjacent to the platform to a second, forward position under the platform;

and means for moving said finder to pull one side of a single bag of the plurality of bags on the platform through the opening in the platform from said upper position to said lower position.

18. A bag filling device as claimed in claim 17, further comprising a nozzle mounted on the main body adjacent the opening in the platform and capable of being coupled to a source of gas.

19. A bag filling device as claimed in claim 17, wherein the finger has at least one tooth.

20. A bag filing device as claimed in claim 17, further comprising a wicket coupled to the platform.

21. A bag filling device comprising:

a main body;

a horizontally-oriented loading bay positioned within the main body and having a bottom, a front, and a rear;

a pusher surface movable along a path extending from the rear of the loading bay to the front of the loading bay;

a platform positioned above and substantially parallel to the loading bay, for supporting a plurality of bags and having an opening therein;

a pair of spreader plates coupled to the main body, positioned at the front of the loading bay, each spreader plate movable along a path parallel to the front of the loading bay extending from substantially the center of the loading bay to said plate's respective side of the loading bay and along a path perpendicular to the front of the loading bay extending from a first, retracted position to a second, extended position;

a finger coupled to the main body and movable along a vertical path extending from the loading bay to the platform and a horizontal path extending from a position adjacent to the front of the loading bay to a position spaced further from the front of the loading bay;

and means for moving the finger to pull one side of a single bag of the plurality of bags on the platform downwardly through the opening in the platform.

* * * * *